US005575893A

United States Patent [19]

Khan et al.

[11] Patent Number: 5,575,893

[45] Date of Patent: Nov. 19, 1996

[54] FELT CONDITIONER FOR DEINKED RECYCLED NEWSPRINT PAPERMAKING SYSTEM

[75] Inventors: Abdul Q. Khan; Kevin D. Curham; Jeffrey R. Cowart, all of Jacksonville, Fla.

[73] Assignee: BetzDearborn Inc., Trevose, Pa.

[21] Appl. No.: 404,771

[22] Filed: Mar. 15, 1995

Related U.S. Application Data

[63] Continuation of Ser. No. 190,417, Feb. 2, 1994.

[51] Int. Cl.[6] ..... D21F 1/32

[52] U.S. Cl. ..... 162/199; 162/5; 162/77; 162/76; 162/7; 162/DIG. 4

[58] Field of Search ..... 162/199, 5, 7, 162/77, 76, 82, DIG. 4

[56] References Cited

U.S. PATENT DOCUMENTS

| | | | |
|---|---|---|---|
| 3,582,461 | 6/1971 | Lipowski et al. | 162/72 |
| 3,932,206 | 1/1976 | Illingworth et al. | 162/5 |
| 3,943,178 | 3/1976 | Stein et al. | 568/622 |
| 4,043,908 | 8/1977 | Roberts et al. | 210/43 |
| 4,311,552 | 1/1982 | Brucato et al. | 162/5 |
| 4,666,558 | 5/1987 | Wood et al. | 162/5 |
| 4,861,429 | 8/1989 | Barnett et al. | 162/199 |
| 4,895,622 | 1/1990 | Barnett et al. | 162/199 |
| 5,073,234 | 12/1991 | Mollett et al. | 162/5 |
| 5,094,716 | 3/1992 | Letscher | 162/7 |
| 5,167,767 | 12/1992 | Owiti et al. | 162/199 |
| 5,211,809 | 5/1993 | Naddeo et al. | 162/6 |
| 5,217,573 | 6/1993 | Tsai et al. | 162/5 |
| 5,225,046 | 7/1993 | Borchardt | 162/5 |
| 5,264,269 | 11/1993 | Kakiuchi et al. | 428/156 |

FOREIGN PATENT DOCUMENTS

WO9307331 4/1993 WIPO .

*Primary Examiner*—Donald E. Czaja
*Assistant Examiner*—Jose A. Fortuna
*Attorney, Agent, or Firm*—Alexander D. Ricci; Richard A. Paikoff

[57] ABSTRACT

A method for conditioning the felts in a papermaking process utilizing deinked secondary fiber in the furnish by adding a felt conditioner consisting of from 5–33% of a nonionic surfactant, from 5–33% of a dispersant, or blends thereof, with the remainder water; wherein the nonionic surfactant is selected from the group consisting of ethoxylated nonylphenols having moles of ethoxylation of from 7.5 to 30 and an HLB of about 12 to 17.2 and di-alkyl phenol ethoxylates having moles of ethoxylation of from 15 to 24 and an HLB of about 13 to 15.1; and wherein the dispersant is selected from the group consisting of the sodium salt of naphthalene sulfonate formaldehyde-condensate having an average molecular weight of from about 700 to 3500, the potassium salt of polymerized alkyl naphthalene sulfonic acid having an average molecular weight of approximately 1000, or the sodium or ammonium salt of lignosulfonate. Additionally, from 1 to 5% of an alkylether hydroxypropyl sultaine enhances performance.

6 Claims, No Drawings

FELT CONDITIONER FOR DEINKED RECYCLED NEWSPRINT PAPERMAKING SYSTEM

This is a continuation of application Ser. No. 08/190,417 filed Feb. 02, 1994.

FIELD OF THE INVENTION

This invention deals with the chemical conditioning of press felts employed in papermaking systems containing deinked old newspaper (ONP) and/or old magazine (OM) -based recycled fiber furnishes alone or in combination with virgin groundwood and/or thermomechanical pulp.

BACKGROUND OF THE INVENTION

Legislative changes coupled with various recycling laws mandated by many state and local governments to increase wastepaper consumption, and the economical benefits that can be realized by utilizing wastepaper, particularly in the newsprint market, have put a burden on papermakers to raise the wastepaper content of their furnishes from a mere 10% to as high as 100% in certain grades of paper; specifically in the deinked newsprint market segment, where, because of availability and low cost, waste newsprint is particularly considered an important feed-stock.

To address these environmental issues as well as to take advantage of economic incentive, many newsprint mills using virgin pulps and unprinted pulp substitutes have been modifying their paper furnish by utilizing deinked newsprint fiber from old newspaper (ONP) and old magazines (OM)in various proportions.

Many mills have even installed integrated deinking facilities on-site which allow them to remove ink from the fiber and other unwanted foreign contaminants by various deinking processes such as washing and/or flotation. The precursor fiber material utilized in a deinking fiber furnish for newsprint may consist of a blend of 60–80% old newspaper (ONP) and the remainder old magazines, and after deinking, this mixture of deinked fiber furnish may constitute as low as 10% of the paper machine furnish (and the remainder virgin groundwood fiber) and as high as 100% deinked stock with no virgin groundwood fiber constituent. A mill's paper machine furnish may even constitute deinked 100% ONP.

The fiber furnish (FF) referred to here is defined as a mixture of precursor fibrous materials consisting of old newspaper (ONP) and old magazines (OM) in a certain mix ratio (such as 70/30) commonly utilized in a deinking process whereas paper machine furnish (PMF) is defined as a mixture of fiber stock consisting of deinked fiber furnish and virgin groundwood fiber along with other desirable papermaking chemical additives utilized in the papermaking process.

Regardless of whether the recycled fibers used in the papermaking furnish are purchased from outside sources or processed on-site via a deinking process, the furnish is not devoid of undesirable contaminants which, if not properly controlled or removed, would severely interfere with the subsequent papermaking processes and ultimately cause production loss and lower quality. The contaminant types, their magnitude, and their adverse effects on the quality and subsequent papermaking process depend on many factors such as deinking efficiency, types of chemical additives used, operating conditions, precursor fiber materials and their mix ratios in fiber and paper machine furnishes, etc.

As these mix ratios of ONP/OM in fiber furnish (FF) for deinking and the deinked fiber vs. virgin groundwood fiber in paper machine furnish (PMF) change, the nature and magnitude of contaminant-related problems, particularly in the press section of a papermaking process, also change. For example, a paper machine furnish (PMF) based on 100% deinked stock may pose no significant pitch deposition problems but may create severe problems related to felt discoloration and excessive deposition of residual ink particles, coating contaminants and fines in the press felt Structure, while a paper machine furnish containing relatively high levels (60% or more, for example) of Southern pine-type mechanical pulp fiber and the remainder deinked fiber furnish may create multiple problems mainly related to pitch, stickles from the use of coated magazine wastepaper and significant ink particle depositions in the press felts as well as on the press section machine components such as the uhle boxes and rolls.

One of the most severe problems associated with the high content level of Southern pine groundwood fiber (laden with virgin pitch) in the paper machine furnish is uhle box deposition in the press section of the paper machine. If proper adjustments in chemical conditions are not made and felts are not adequately conditioned, these contaminants tend to deposit on the uhle box surface (due to extreme shear) and thus requires frequent clean-ups in order to prevent vacuum loss, felt degradation and eventual loss of water removal capability of the press felts.

For a felt to maintain its useful function on a paper machine, it must be dewatered and cleaned as it passes around the paper machine prior to re-entering the press nip. This is commonly accomplished by the use of uhle boxes. Also, for efficient press section operation, the efficiency of the uhle boxes is extremely important in the removal of contaminants from the felt on a continuous basis without damaging the felt surface fibers. If uhle box deposition is not controlled effectively, the aforementioned deposits in felts and on uhle box surfaces tend to damage the surface batt fibers of felt, resulting in streaking, premature removal of expensive felt(s) and ultimately production loss and lower quality. Uhle box deposition problem is often addressed by machine operators manually scraping off the deposits from the uhle box surface on a regular basis which can pose a significant safety hazard, as well as causing problems due to particles falling on the felts or paper sheet.

Another common runnability and quality problem for mills using high levels of coated magazine in the ONP/OM fiber furnish is the "stickies" problem which deposit in felts and paper machine components or show on the sheet as spots. The primary sources of stickies may be contact adhesives, tapes, labels, decals, hot melts, seam binding, wax, ink, latexes, wet strength resins, etc. which generally emanate from high level of OM content in the furnishes. The use of coated grade paper in the fiber furnish may also introduce sticky substances composed mainly of latex binder (coating mixture of PVAC, SBR, $TiO_2$, $CaCO_3$, other inorganics) which agglomerate into stickies. Stickies are prone to deposit on uhle boxes, press rolls, dryer cans, press felts, dryer fabrics, etc., which ultimately cause sheet holes/spots besides productivity loss. These problems are much more severe in mills that have closed paper machine white water systems.

The use of 100% deinked fiber as paper machine furnish is becoming quite popular with a different set of problems related to ink and their deposition potential in press felts.

Newsprint inks are composed of two main types: so called letter-press ink and offset ink. Both types are a complex mixture of ingredients including pigments which are responsible for providing color (tend to discolor the felt); vehicles which are responsible for transferring the pigment via press to the paper and holding them (bonds to the felt batt fibers), and the modifiers to achieve specific end-use physical properties. Majority of the printing inks contain carbon black as pigment, with and without organic pigment (also called toner) more commonly employed in color printing of magazines. Vehicles (also called binders and are organic component often with ionic group) part of the ink may contain one or more vegetable drying oil, mineral oil, varnish and solvents, lacquers, shellacs, acrylic and other polymeric emulsions, nitro and other cellulosic derivatives. Modifiers could contain components such as clay, waxes, rosin, glycol, gums, rubber defoamers, silicones, etc.

Typical deinking chemical additives employed during a deinking process may include sulfuric acid, sodium hydroxide, sodium silicate, hydrogen peroxide, surfactants, chelants (such as DTPA-diethylene triamine penta acetic acid), and calcium chloride, etc. each with specific function to perform at various stages of the deinking process. The carryover residuals of these well intended chemicals in fiber furnish sometimes aggravate other contaminants present in the subsequent papermaking process and show-up as problematic contaminants particularly in the press section of the papermaking system.

Another problem seriously affecting the press section felts is the use of recycled water as shower water where insoluble ultra-fine particles (fines) may cause serious felt filling problems if these fines are not removed by the uhle boxes. A high percentage of fabrics and felts taken off in mills using deinked fibers are removed because they have been partially filled with fines and other contaminants. The insoluble contaminants are trapped by the tight fiber mat, filling the void volume of felts, and thus reducing their water removal capability.

All these undesirable fines and non-fibrous contaminants introduced in the paper machine system either by necessity or inherent with the fiber and/or paper machine furnishes are extremely difficult to eliminate completely and, therefore, they tend to deposit on the uhle box surface, and in the felt structure, thus reducing the void volume of the felt, excessive discoloration of felt in the case of high deinked fiber content in paper machine furnish, etc. and thus the ultimate result is poor runnability and quality problems.

Papermaking machines are well known in the art. The modern papermaking machine is in essence a device for removing water from the paper furnish. The water is removed sequentially in three stages or sections of the machine. In the first or forming section, the paper furnish is deposited on a moving forming wire and water drained through the wire to leave a paper sheet or web having solids content of 18–25% by weight. The formed fiber web is carried into a press section and passed through one or more roll nip presses on moving press felts to remove sufficient water to form a sheet. This sheet is transferred to the third stage known as dryer section of the paper machine. The present invention deals with the continuous conditioning treatments of press felts employed in the second stage known as the press section where the above-mentioned dispersed substances and/or small particulate impurities emanating from the use of deinked paper furnish (along with chemical additives ), if not effectively treated or retained in the sheet, would deposit in press felts, on uhle box, machine rolls and thus render felts and uhle box ineffective by reducing their water handling capabilities.

Because of a variety of multi-component contaminants (pitch, stickies, ink, deinking chemicals, etc. ) present in the deinked newsprint type paper machine furnish and various distinct problems arising from them (such as discoloration of felt, uhle box deposition, felt filling, etc.); various conventional reagents, solvents, surfactants, dispersants, wetting agents, etc. and their combinations employed in the prior art have shown very limited effectiveness toward addressing these multiple problems occurring in the press section of the papermaking process. In fact, many references cited in the prior art search deal only with the various aspects of deinking process chemistry and equipment involved but none with the chemical conditioning of felts and contaminants in a papermaking system utilizing deinked fiber. The present inventors have discovered that significant superior results with respect to felt cleanliness, inhibition of contaminants deposition in the felt structure as well as uhle box deposition can be obtained by applying the felt conditioning treatments according to the teachings of this invention.

DETAILED DESCRIPTION OF THE INVENTION

It is an object of this invention to provide a single or multi-component felt conditioning chemical treatment to address the above mentioned problems individually or collectively.

The present inventors have surprisingly discovered that significant superior results are obtained by selectively applying the treatment of single components a, b or blends of multi-component formulas of a-b, b-c, a-c and a-b-c to the felts and/or uhle box via water showers to prevent contaminant fill-up in felts, prevent uhle box deposition and enhance cleanliness of felts by inhibiting residual ink particles deposition. The selection of the most appropriate treatment formula will depend on the type and severity of the contaminant problems and the end results desired. In this invention the treatment components a, b and c are:

a: represents a group of nonionic surfactants consisting of ethoxylated nonylphenols having moles (n) of ethoxylation in the range of 7.5–30 and HLB in the range of 12–17.2; or di-alkyl phenol ethoxylates having moles (n) of ethoxylation in the range of 15–24 and HLB in the range of approximately 13 to 15.1 b: represents a group of dispersants consisting of sodium salt of napthalene sulfonate formaldehyde-condensate having an average molecular weight in the range of 700–3500; potassium salt of polymerized alkyl napthalene sulfonic acid having molecular weight of approximately 1000; or sodium or ammonium salts of lignosulfonate.

c: alkylether hydroxypropyl sultaine.

Depending upon the severity of problems with respect to felt filling, uhle box deposition and ink particles deposition and discoloration of felts, one or more components from each group can be blended together and the level of each component may also vary with respect to desired formulas efficacy, stability, economics, physical characteristics (such as viscosities at low and high temperatures), etc.

For example, in situations where felt filling with groundwood pitch contaminants is a major problem and uhle box deposition is also a significant problem, a single component formula a alone and/or multi-component blends of a-b, a-c with a minimal level of c and a relatively high level of a, or a-b-c could be effectively employed whereas in the case of 100% deinked stock based paper machine furnish where the uhle box deposition problem is minimal but ink and coating particle deposition and felt discoloration is considered important, a high level of b alone or in combination with a and/or c have been found to be preferred treatments.

The preferred embodiment of this invention is a-b-c where a is single or multi-component blends of two or more from a group of alkylethoxylates of the chemical structure:

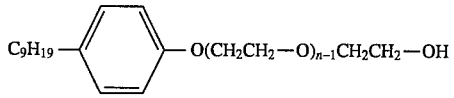

where n=9.5–12, HLB in the range of 12 to 15 and/or a component of ethoxylated di-nonylphenol having the chemical structure:

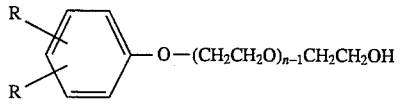

where n=15–24, where R is a nonyl grouping and, b:

is a sodium salt of napthalene sulfonate formaldehyde condensate having molecular weight of approximately 1800–2400, with chemical structure:

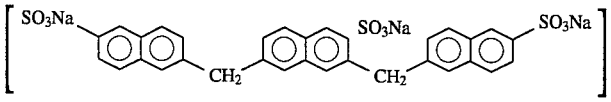

and/or sodium or ammonium lignosulfonate and, c:

is a sodium salt of alkylether hydroxypropyl sultaine having the chemical structure:

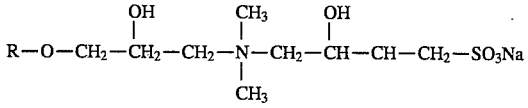

where R is alkyl radical of $C_8$–$C_{12}$, preferably $C_{10}$.

The selection of a treatment formula and its application depends on the quality of deinked stock, mix ratio of deinked stock vs. virgin fiber in paper machine furnish, severity of felt filling and uhle box deposition problems encountered and the degree of felt cleanliness desired. The present invention is to be utilized where deinked newsprint comprises about 10 to 100% of the furnish or, where a blend of deinked newsprint and deinked old magazines comprises from 10 to 100% of the furnish. The typical % aqueous concentration of each component in the multi-component formulas may range from approximately 5–33% for a and b, whereas c may range from 1 to 5% of the formulation concentration with the remainder water or other suitable polar diluent.

The required amount of felt conditioning chemical treatments will depend on, among other things, the volume of shower water employed, production rate and the degree of contaminants coming through on the felts.

Generally, the total active ingredient concentration of the selected conditioning agent of this invention may range from 50 ppm to 2000 ppm of the aqueous medium to be delivered through the various showers in the paper machine. Preferably, from 75 to 750 ppm of aqueous medium is used. The showers through which the aqueous medium may be sprayed include the high pressure shower, the uhle box lube shower, the chemical shower, the felt shower and the roll shower.

Furthermore, it is also believed that the embodied invention can also be effectively utilized to prevent the same type of contaminants from building up on machine rolls when the treatment is fed continuously onto the rolls through an appropriate aqueous medium.

In order to more clearly illustrate the present invention the following series of data were generated and illustrated in examples.

Test Method

The examples contained herein will demonstrate the unexpected superior responses produced by the present invention. The felt conditioning results were obtained utilizing a test apparatus and simulated synthetic contaminants having 60/40 Southern pine groundwood type pitch (60%) and 40% deinked newsprint type furnish contaminants (50/50 ONP/OM mix ratio) in actual newsprint mill white water. In the second set of tests, 100% deinked fiber furnish contaminants (with no Southern pine pitch) was utilized. For conditioning, the testing incorporates clean (unused) press felt samples of known initial weight and air porosity (CFM) placed on a heavy-mesh support screen through which the treatment solution (with or without conditioning agent) is passed under high pressure where contaminant deposition and felt compaction phenomena (simulating paper machine press roll nips) occur simultaneously. After drying, the felt samples are re-checked for % weight gain and % porosity loss. Lower % weight gain and % porosity loss results are indicative of a conditioning agent's effectiveness. Since % porosity loss data is affected by % contaminant deposition, as well as, mechanical compaction of felt, % weight gain data is generally considered more favorably as compared to % porosity loss in assessing the effectiveness of a conditioning agent. The make-up of various contaminant mixtures employed for 60/40 and 100% deinked paper machine furnish contaminants are summarized in Table I. Because of their commercial significance, test data were generated for 60% virgin pitch/40% deinked contaminants and 100% deinked contaminant systems. For uhle box deposit test the make-up and preparation of the Southern pine groundwood pitch type contaminant was as follows:

1800 grams of DI water is heated to approximately 130° F. and then pH is adjusted to 12.0 using 50% NaOH. 4.05 grams of abietic acid is dissolved in the above solution and then 0.9 gram of mixture of rosin acid and fatty acid (Sylvatal 40 from Arizona Chemical Company) is added to the solution while stirring. To this mixture, 50 grams of warm acetone solution containing dissolved mixture of 0.9 gram Stigmasterol (Aldrich Chemical Company) and 3.15 grams tall oil pitch is slowly added and stirred until completely dispersed. The pH of the final slurry is adjusted to 8.0 with dilute HCl. The temperature of this master batch slurry is maintained at 130° F. with mild agitation during subsequent uhle box deposition testing. For the uhle box deposition test, 50 grams of the above master batch slurry diluted with 650 grams of hot tap water (approximately 130° F.) with pH adjusted to 4.5 is used in a blender jar in which a doughnut shaped 2" diameter plastic coupon is fashioned and attached to the metal blender base. The contaminant slurry was added to the blender and stirred at high shear speed for 5 minutes (for contaminant deposition) and then the same coupon, after rinsing with DI water, is subjected to 5 minutes of washing with and without the conditioning agent and water in blender. The plastic coupon is then air dried and the deposit weight of the coupon is determined by the difference between the pre-weighed clean and the deposit-laden weight (after washing cycle) of the plastic coupon. Similar tests were repeated with treatments/water in washing cycle to determine their effectiveness.

TABLE I

Felt Conditioning Testing Contaminant System Make-up

| Component | 60/40 (SGW/Deinked) pH = 4.5 (ppm) | 100% Deinked pH = 6 (ppm) |
|---|---|---|
| KOH | 68 | 56 |
| Fatty Ester | 300 | — |
| Abietic Acid | 300 | — |
| Alum | 75 | — |
| Cationic Polymer | — | — |
| Ink | 140 | 280 |
| Coating* | 700 | 500 |
| Cured SGW** | — | 1400 |

*88% Clay, 2% Pigment, 10% Latex (heat-cured and re-dispersed)
**50% Heated-cured, Re-dispersed Fatty Ester Pitch + 50% Aluminum Abietate.

Results are calculated as % of deposit removed for each test. Prior to each conditioning agent test, a control test (with no conditioning agent in washing water) is run to maintain accuracy. The lower the % of control, the better is the effectiveness of a conditioning agent against uhle box deposition.

Illustration 1

A series of tests with single component treatments selected from a, b or c, and other relevant chemical treatments were conducted in 60/40 contaminant systems following the above described procedures for felt conditioning efficacy and uhle box deposition control. All single components were tested at equivalent 150 ppm active for felt conditioning efficacy while for the uhle box deposition test, 1500 ppm dosage was utilized. The results are summarized in Table II.

As it can easily be seen from Table II, nonionic surfactants of group a having 7.5–30 degrees of ethoxylation and HBL values in the range of 12–17.2 showed significantly superior results toward controlling the contaminant deposition in felts. They were also effective on uhle box deposition control whereas many other types of anionic and nonionic surfactants and wetting agents commonly known in the prior art were ineffective. Furthermore, some of the treatments even aggravated the deposition in felts, while some of them were effective only on controlling uhle box deposition. Similarly, group b treatments were extremely effective toward conditioning the felts but totally failed to prevent uhle box deposition, and in some cases even aggravated the deposition.

Surprisingly, the group c component when tested alone was ineffective toward preventing the contaminant deposition in felts, as well as in the uhle box deposition control test. However, its combination with groups a and b yielded superior results.

TABLE II

Single Component Treatment Results (60/40 Contaminant System, pH 4.5)

| Treatment | | | Felt Conditioner % Wt. Gain | Felt Conditioner % Porosity Loss | Uhle Box Deposition Control % of Control |
|---|---|---|---|---|---|
| Untreated Control | | | 24.7 | 63 | 100.0 |
| Surfactants (a) | | | | | |
| Nonylphenol Ethoxylates | | | | | |
| Example | n* | HLB | | | |
| 1 | 6.0 | 10.8 | 25.8 | 69 | 68.7 |
| 2 | 7.5 | 12.2 | 10.2 | 55 | 55.3 |
| 3 | 9.0 | 13.0 | | | 40.2 |
| 4 | 9.5 | 12.9 | 8.6 | 51 | 68.2 |
| 5 | 12.0 | 14.2 | 8.8 | 49 | 15.2 |
| 6 | 15.0 | 15.0 | 6.21 | 30 | 18.2 |
| 7 | 30.0 | 17.2 | 8.9 | 37 | 65.5 |
| *n = moles of ethylene oxide per mole of nonylphenol | | | | | |
| Di-nonylphenol Ethoxylates | | | | | |
| Example | n* | HLB | | | |
| 8 | 9.6 | 10.6 | 18.0 | 64 | 71.0 |
| 9 | 15.0 | 13.5 | 7.3 | 48 | 78.5 |
| 10 | 24.0 | 15.1 | 4.4 | 24 | 96.7 |
| Legend: | | | | | |
| Example 1 = Igepal CO-530, Rhone-Poulenc | | | | | |
| Example 2 = Igepal CO-610, Rhone-Poulenc | | | | | |
| Example 3 = Igepal CO-630, Rhone-Poulenc | | | | | |
| Example 4 = Surfonic N-95, Texaco Chemical Co. | | | | | |
| Example 6 = Igepal CO-730, Rhone-Poulenc | | | | | |
| Example 7 = Igepal CO-880, Rhone-Poulenc | | | | | |
| Example 8 = Igepal DM-530, Rhone-Poulenc | | | | | |
| Example 9 = Igepal DM-710, Rhone-Poulenc | | | | | |
| Example 10 = Igepal DM-730, Rhone-Poulenc | | | | | |
| Dispersants (b) | | | | | |
| Napthalene Sulfonate Formaldehyde Condensate with: | | | | | |
| Example | Molecular Weight | | | | |
| 11 | 700 | | 2.1 | 19 | 101.5 |
| 12 | 1000 | | 4.9 | 42 | 97.5 |
| 13 | 2400 | | 1.4 | 14 | 89.4 |
| 14 | 3500 | | 3.1 | 21 | 117.2 |
| 2. Sod. Lignosulfonate* | | | 3.6 | 31 | 104.8 |
| Example 11 = Blancol N, Rhone-Poulenc | | | | | |
| Example 12 = Tamol SN, Rohm & Haas | | | | | |
| Example 13 = Galflo 3440, Lobeco Products, Inc. | | | | | |
| Example 14 = Vultamol NHSA, BASF | | | | | |
| *Lignosol XD, Lignotech USA, Inc. | | | | | |
| Wetting Agent (c) | | | | | |
| Alkylhydroxy Propyl Sultaine* | | | 25.8 | 77 | 93.4 |
| *Mirataine ASC, Rhone-Poulenc | | | | | |
| Other Surfactants and Raw Materials | | | | | |
| Linear Alcohol Ethoxylates of Complex Phosphate Ester (A) | | | 26.5 | 80 | 71.2 |
| Nonylphenol Ethoxylate Complex Phosphate Ester (B) | | | 28.0 | 84 | 26.7 |
| Phenol Ethoxylate Complex Phosphate Ester (C) | | | 18.8 | 73 | 93.4 |
| Primary Alcohol | | | 24.9 | 71 | 55.3 |

TABLE II-continued

| Single Component Treatment Results (60/40 Contaminant System, pH 4.5) | | | |
|---|---|---|---|
| | Felt Conditioner | | Uhle Box Deposition |
| Treatment | % Wt. Gain | % Porosity Loss | Control % of Control |
| Ethoxylate | | | |
| Alkyl Polyglucosides | 22.4 | 75 | — |
| Sodium n-decyl Diphenyloxide Disulfonate | 24.1 | 87 | 25.1 |
| Sodium n-hexadecyl Diphenyloxide Disulfonate | 11.3 | 58 | 79.3 |
| Tri-decyl Alcohol Ethoxylate | 23.9 | 71 | 55.0 |
| Unidecyl oxo-alcohol ethoxylate | 23.4 | 73 | — |
| Dipropylene Glycol Methylether (DPM solvent) | — | — | 95.3 |
| Alkyl Betaine | 17.2 | 63 | 81.6 |

Illustration 2

In these series of tests, treatments of two and three chemical component blends selected from a, b and c of this invention were utilized in testing with two different contaminant systems representing a 60/40 mix ratio of paper machine furnish; and 100% deinked stock (no Southern pine groundwood pitch contaminants).

Each felt conditioning treatment test was carried out utilizing a 600 ppm treatment for 60/40 and 1200 ppm for 100% deinked stock contaminant system. For uhle box deposition testing, 1500 ppm of treatment was employed. The test procedure for both types of tests remained the same as described prior to Example 1. The test results obtained are summarized in Tables IIIA (representing a 60/40 system) and IIIB (representing a 100% deinked system).

As it can be seen from the test results in Tables IIIA and B, two-component treatment formulas containing 5–33% a and 5–33% b and 0–5% c could be effectively employed to prevent contaminant deposition in felt and keep the felts looking relatively clean.

The three-component based formula consisting of a and b (5–33%) and 5% c described above produced overall the best results in terms of preventing felt filling and uhle box deposition, as well as, keeping the felt looking clean.

By contrast, increasing the c component to 33% level did not produce satisfactory results.

For appearance, samples are ranked by cleanliness, denoted by numbers 1–5, with 1 being the cleanest.

TABLE III

Two and Three-Component Treatment Results

| % Concentration in Aqueous Formula | | | | Felt Conditioner Treatment Efficacy Results 60/40 System | | Uhle Box | |
|---|---|---|---|---|---|---|---|
| | | | | % Wt. Gain | % Porosity Loss | Efficacy (% of Control) | Test Sample Appearance 60/40 System |
| Untreated Control | | | | 24.7 | 63 | 100.0 | 5 |
| Two Component Blends | | | | | | | |
| Example | x | y | z | | | | |
| 15 | 33 | 5 | — | 10.2 | 38 | 97.6 | 3 |
| 16 | 33 | — | 5 | 9.0 | 38 | 96.4 | 3 |
| 17 | 5 | 33 | — | 3.4 | 15 | 81.3 | 2 |
| 18 | 5 | — | 33 | 26.1 | 71 | 95.8 | 5 |
| 19 | — | 33 | 5 | 2.9 | 12 | 81.3 | 2 |
| 20 | — | 5 | 33 | 16.8 | 53 | 95.8 | 4 |
| Three Component Blends | | | | | | | |
| Example | x | y | z | | | | |
| 21 | 33 | 5 | 5 | 7.5 | 37 | 42.7 | 2 |
| 22 | 5 | 33 | 5 | 4.2 | 21 | 125.0 | 2 |
| 23 | 5 | 5 | 33 | 10.3 | 45 | 99.2 | 3 |
| 24 | 33 | 33 | 33 | 8.9 | 43 | 109.2 | 3 |

Legend:
x = 33% Igepal CO-720 + 67% Surfonic N-95
y = 100% Galflo 3440
z = 100% Mirataine ASC

| % Concentration in Aqueous Formula | | | | Felt Conditioner Treatment Efficacy Results 100% Deinked | | Uhle Box | Test Sample |
|---|---|---|---|---|---|---|---|
| | | | | % Wt. Gain | % Porosity Loss | Efficacy (% of Control) | Appearance 100% Deinked |
| Untreated Control | | | | 14.8 | 50 | 100.0 | 5 |
| Two Component Blends | | | | | | | |
| Example | x | y | z | | | | |
| 25 | 33 | 5 | — | 7.2 | 29 | 97.6 | 3 |
| 26 | 33 | — | 5 | 6.8 | 29 | 96.4 | 3 |
| 27 | 5 | 33 | — | 7.8 | 27 | 81.3 | 3 |
| 28 | 5 | — | 33 | 18.7 | 59 | 95.8 | 5 |
| 29 | — | 33 | 5 | 7.7 | 30 | 81.3 | 3 |
| 30 | — | 5 | 33 | 14.2 | 42 | 95.8 | 4 |
| Three Component Blends | | | | | | | |
| Example | x | y | z | | | | |
| 31 | 33 | 5 | 5 | 6.4 | 24 | 42.7 | 2 |
| 32 | 5 | 33 | 5 | 10.2 | 33 | 125.0 | 3 |
| 33 | 5 | 5 | 33 | 25.6 | 65 | 99.2 | 5 |
| 34 | 33 | 33 | 33 | 10.9 | 35 | 109.2 | 3 |

Legend:
x = 33% Igepal CO-720 + 67% Surfonic N-95
y = 100% Galflo 3440
z = 100% Mirataine ASC Illustration 3

In this test, the preferred embodiment of the invention was tested in 60/40 contaminant system containing a small amount of cationic polyacrylamide retention aid polymer (0.5 ppm) while the rest of the contaminant remained the same as described in Tests 1 and 2. The results are summarized in Table IV showed the effectiveness of the preferred treatment in this system also.

TABLE IV

| Treatment Formula | | | | Felt Conditioner Treatment Efficacy (60/40 System, pH = 4.5) | |
|---|---|---|---|---|---|
| | | | | % Weight Gain | % Porosity Loss |
| Untreated Control | | | | 23.8 | 76.0 |
| Three Component Preferred Formula: | | | | | |
| | x | y | z | | |
| | 33 | 5 | 5 | 6.7 | 49.0 |

Legend:
x = 33% Igepal CO-720 + 67% Surfonic N-95
y = 100% Galflo 3440
z = 100% Mirataine ASC

We claim:

1. A method for controlling contaminant build-up in a papermaking process utilizing deinked secondary fiber in the furnish comprising adding a combination of: (a) from 5–33% of a nonionic surfactant, (b) from 5–33% of a dispersant or blends thereof, (c) from 1 to 5% of an alkylether hydroxypropyl sultaine, with the remainder water; wherein the nonionic surfactant is selected from the group consisting of ethoxylated nonylphenols having moles of ethoxylation of from 7.5 to 30 and an HLB of about 12 to 17.2 and di-alkyl phenol ethoxylates having moles of ethoxylation of from 15 to 24 and an HLB of about 13 to 15.1; and wherein the dispersant is selected from the group consisting of a sodium salt of naphthalene sulfonate formaldehyde-condensate having an average molecular weight of from about 700 to 3500, a potassium salt of polymerized alkyl naphthalene sulfonic acid having an average molecular weight of approximately 1000 and a sodium or ammonium salt of lignosulfonate, said combination serving to control contaminant build-up in felt, uhle box deposition and maintain felt cleanliness.

2. The method of claim 1 wherein the furnish comprises from about 10 to 100% deinked newsprint.

3. The method of claim 1 wherein the furnish comprises from about 10 to 100% of a blend of deinked newsprint and deinked old magazines.

4. The method of claim 1 wherein the combination is added to the papermaking process in the concentration of from 50 ppm to 2000 ppm.

5. The method of claim 4 wherein the aqueous medium is sprayed through a shower onto the felt.

6. The method of claim 5 wherein the shower is selected from the group consisting of a uhle box lube shower, a high pressure shower, a chemical shower, a felt shower and a roll shower.

* * * * *